US010051886B2

(12) United States Patent
De Gaglia

(10) Patent No.: US 10,051,886 B2
(45) Date of Patent: Aug. 21, 2018

(54) SMOKING DEVICE FOR ORGANIC MATERIAL

(71) Applicant: John De Gaglia, Coral Springs, FL (US)

(72) Inventor: John De Gaglia, Coral Springs, FL (US)

( * ) Notice: Subject to any disclaimer, the term of this patent is extended or adjusted under 35 U.S.C. 154(b) by 1063 days.

(21) Appl. No.: 14/318,059

(22) Filed: Jun. 27, 2014

(65) Prior Publication Data

US 2015/0374032 A1 Dec. 31, 2015

(51) Int. Cl.

| | |
|---|---|
| ***A24F 1/30*** | (2006.01) |
| ***A24F 1/00*** | (2006.01) |
| ***A24F 5/00*** | (2006.01) |
| ***A24F 7/00*** | (2006.01) |

(52) U.S. Cl.

CPC ..... *A24F 1/30* (2013.01); *A24F 1/00* (2013.01); *A24F 5/00* (2013.01); *A24F 7/00* (2013.01)

(58) Field of Classification Search

None

See application file for complete search history.

(56) References Cited

U.S. PATENT DOCUMENTS

| | | | | |
|---|---|---|---|---|
| 4,116,204 | A | 9/1978 | Kline | |
| 4,165,753 | A * | 8/1979 | Stryker | A24F 1/30 131/173 |
| 7,806,123 | B2 | 10/2010 | Mehio | |
| 2002/0069886 | A1 | 6/2002 | Couch | |
| 2008/0072917 | A1 | 3/2008 | Lee | |
| 2012/0180803 | A1 | 7/2012 | Beloni | |

FOREIGN PATENT DOCUMENTS

| | | |
|---|---|---|
| CN | 2448125 | 9/2001 |
| CN | 201018918 | 2/2008 |

* cited by examiner

*Primary Examiner* — Dennis R Cordray

(74) *Attorney, Agent, or Firm* — Christopher & Weisberg, P.A.

(57) ABSTRACT

A plurality of threaded tubes having an internal surface, a first end, and a second end opposite the first end, the plurality of threaded tubes including internal threads on the internal surface proximate the first end, and second internal threads proximate the second end. A plurality of threaded connecting rings having an external surface is included, the plurality of threaded connecting rings having threads around the exterior surface that threadably mate with the corresponding internal threads on two of the plurality of threaded tubes. A base threadably matable to one of the plurality of threaded tubes is included, the base, the plurality of threaded tubes, and the plurality of threaded connecting rings cooperate to form a reservoir. A stem having a first end and a second end is included, the first end being connected to the base. A bowl is included connected to the second end of the stem.

20 Claims, 4 Drawing Sheets

SMOKING DEVICE FOR ORGANIC MATERIAL

FIELD OF THE INVENTION

The present invention relates generally to a smoking device for organic material, and more particularly, to a modular hygienic water pipe that may be disassembled for packing when traveling and reassembled for use.

BACKGROUND

Smoking devices and hookahs are well known in the art. Smoking devices employing pipes typically include a unitary cylindrical body with a bowl for holding organic smoking material connected to the lower end of the body by a stem and mouth piece or opening at the top end for drawing smoke from the bowl, through the stem, up the body and out the opening. Water or other liquid is placed in the bottom of the smoking pipe for filtering the smoke. Hookahs normally have multiple mouth pieces connected to the smoking pipe by flexible tubes.

Known smoking devices, however, are complicated in design, inconvenient to package and conceal, primarily not hygienic, and difficult to clean. The smoking devices known are also are often made of material which conducts heat, thereby making use unpleasant. In addition, known smoking devices do not prevent contamination of the smoking material that can be caused by back wash from liquid in the pipe. Moreover, existing smoking devices typically have fixed, i.e., permanent mouth pieces and bowls, thereby raising concerns relating to cleanliness and sanitation and are difficult to clean.

SUMMARY

The present invention provides a modular smoking device for organic material including a plurality of threaded tubes having an internal surface, a first end, and a second end opposite the first end, the plurality of threaded tubes including internal threads on the internal surface proximate the first end, and second internal threads proximate the second end. A plurality of threaded connecting rings having an external surface is included, the plurality of threaded connecting rings having threads around the exterior surface that threadably mate with the corresponding internal threads on two of the plurality of threaded tubes. A base threadably matable to one of the plurality of threaded tubes is included, the base, the plurality of threaded tubes, and the plurality of threaded connecting rings cooperate to form a reservoir. A stem having a first end and a second end is included, the first end being connected to the base. A bowl is included connected to the second end of the stem.

In another embodiment, the modular smoking device for organic material includes a plurality of threaded tubes having an internal surface, a first end, and a second end opposite the first end, the plurality of threaded tubes including internal threads on the internal surface proximate the first end, and second internal threads proximate the second end. A plurality of threaded connecting rings having an external surface is included, the plurality of threaded connecting rings having threads around the exterior surface that threadably mate with the corresponding internal threads on the plurality of threaded tubes. A base threadably matable to one of the plurality of threaded tubes is included, the base, the plurality of threaded tubes, and the plurality of threaded connecting rings cooperate to form a reservoir. The plurality of threaded connecting rings have a concentric ridge proximate a midpoint on the connecting rings to limit the distance the plurality of threaded connecting rings move into the plurality of threaded tubes.

In yet another embodiment, the modular smoking device for organic material includes a plurality of threaded tubes having an internal surface, a first end, and a second end opposite the first end, the plurality of threaded tubes including internal threads on the internal surface proximate the first end, and second internal threads proximate the second end. A plurality of threaded connecting rings having an external surface is included, the plurality of threaded connecting rings having threads around the exterior surface that threadably mate with the corresponding internal threads on the plurality of threaded tubes. A base threadably matable to one of the plurality of threaded tubes is included, the base, the plurality of threaded tubes, and the plurality of threaded connecting rings cooperate to form a reservoir. The base defines a base aperture. The plurality of threaded connecting rings having a concentric ridge proximate a midpoint on the connecting rings to limit the distance the plurality of threaded connecting rings move into the plurality of threaded tubes. A stem having a threaded first end and a threaded second end is included, the threaded first end being threadably connectable to the threaded base aperture. A bowl having a threaded aperture is included, the threaded second end of the stem being threadably received within the threaded aperture. A one-way valve disposed within the stem for preventing a liquid from entering the bowl is included. The plurality of threaded connecting rings have a concentric ridge proximate a midpoint on the plurality of threaded connecting rings to limit the distance the rings travel into the plurality of threaded tubes.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION

A modular pipe for smoking organic material is provided. The modular water pipe may have several double sided threaded tubes connected together by double-sided threaded connectors and single-sided threaded connectors at the top and bottom, at least one stem with a bowl connected to the bottom section and a one way valve in the stem to prevent wash from compromising the organic material. The tubes may be made from glass, porcelain or other material that does not readily conduct heat.

Figure 1:
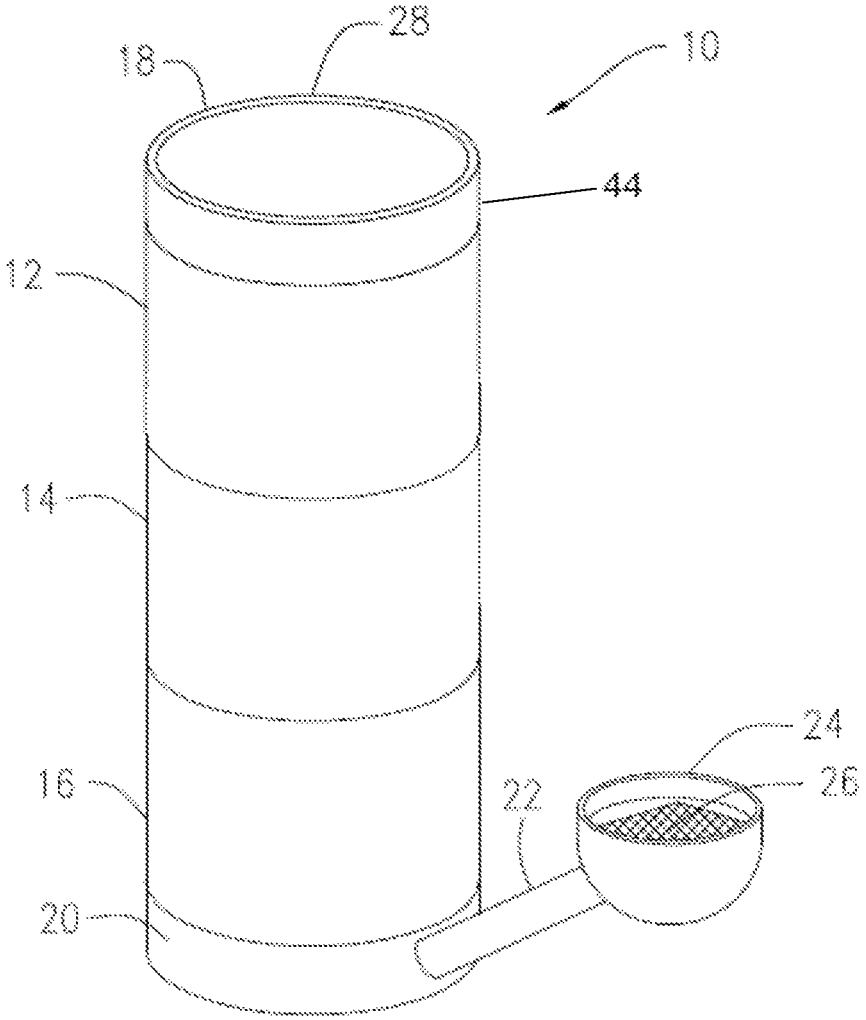
FIG. 1 is a perspective view of a smoking device constructed in accordance with the principles of the present invention.

Now referring to the drawings in which like reference designators refer to like elements, there is shown in FIG. 1 a modular smoking device constructed in accordance with the principles of the present invention and designated generally as "10." The smoking device 10 may define an internal reservoir formed by a first tube 12, a second tube 14, a third tube 16, a top collar 18, and a base 20 releasably coupled together to define a reservoir. A stem 22 is releasably connected to and extends from the base 20. A bowl 24 for placing organic smoking material is connected to the stem 22. The bowl 24 includes a screen 26 for holding the organic material in the bowl 24 while it is ignited and drawn from during smoking. The top collar 18 connects to the first tube 12 and provides a smooth upper ring that acts as a mouthpiece 44. The mouthpiece 44 may include a disposable overlay on the smooth upper ring of the top collar 18. In use, smoke is drawn from the organic material when ignited, through the reservoir and out the through top collar 18. Of note, although FIG. 1 (as well as FIGS. 2-5) show three tubes 14, 16 and 18, the invention is not limited to such. It is contemplated that fewer of more tubes can be used depending on design objectives such as side, portability, etc.

Figure 2:
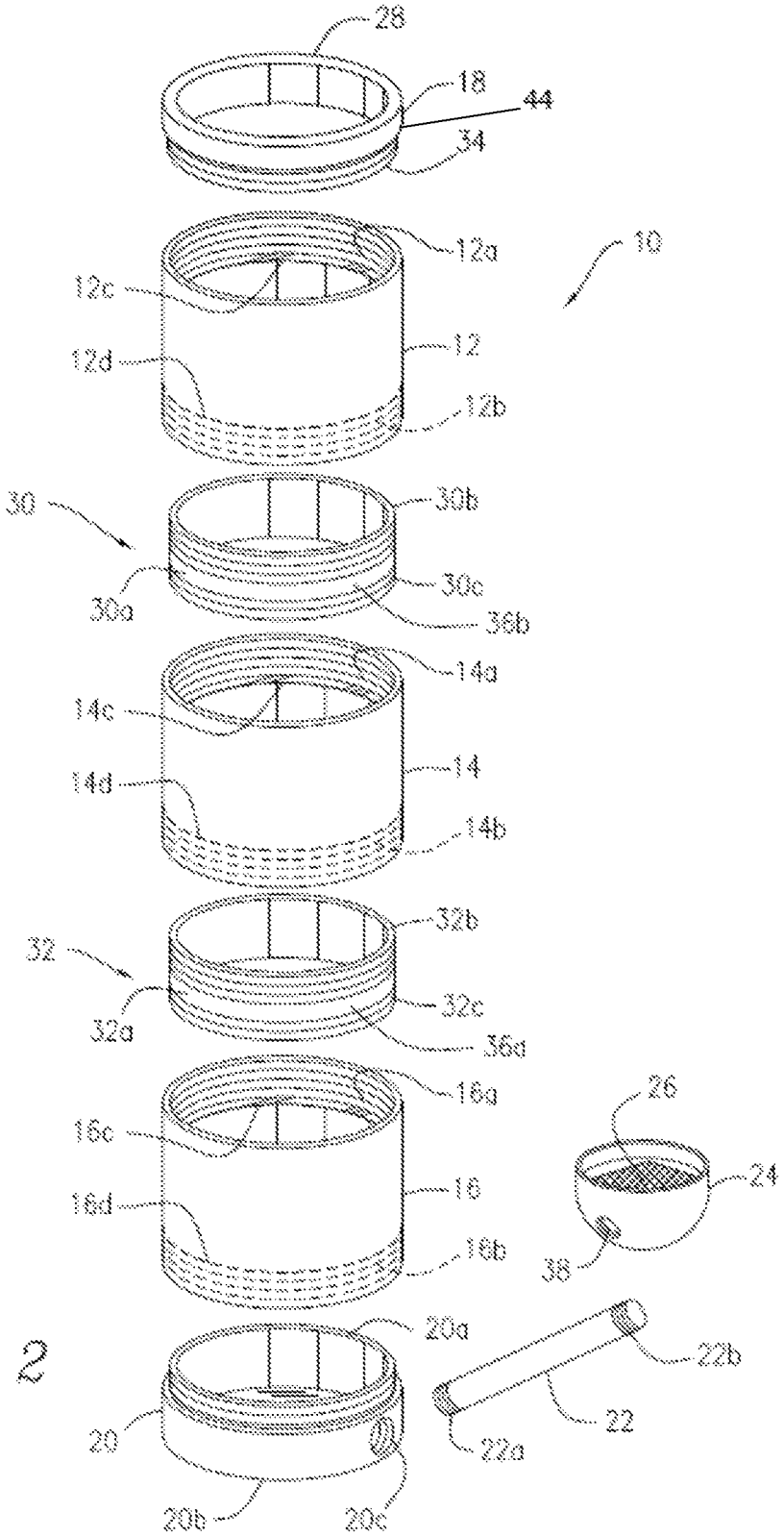
FIG. 2 is a perspective exploded view of the smoking device shown in FIG. 1.

Now referring to FIG. 2, the first tube 12, second tube 14 and third tube 16 include dual-threaded cylinders that are releasably connected together by a first threaded connecting ring 30 and a second threaded connecting ring 32 respectively. The first tube 12 includes internal threads 12*a* at an upper end and internal threads 12*b* at lower end opposite the upper end. The second tube 14 includes internal threads 14*a* at an upper end and internal threads 14*b* at a lower end. The third tube 16 includes internal threads 16*a* at an upper end and internal threads 16*b* at a lower end. The first threaded connecting ring 30 includes external threads 30*a* that threadably mate at an upper end 30*b* with internal threads 12*b* and at a lower 30*c* with internal threads 14*a* to connect the first tube 12 to the second tube 14. In one embodiment, the first tube 12 may include an internal ridge 12*d* to limit the distance the first connecting ring 30 penetrates the tube 12. Similarly, the second tube 14 may include an internal ridge 14*c* to limit the distance the first connecting ring 30 penetrates the second tube 14.

Continuing to refer to FIG. 2, the second threaded connecting ring 32 includes external threads 32*a* that threadably mate at an upper end 32*b* with internal threads 14*b* and at a lower end 32*c* with internal threads 16*a* to connect the second tube 14 to the third tube 16. The second tube 14 may include an internal ridge 14*d* to limit the distance the second connecting ring 32 penetrates the second tube 14. Similarly, the third tube 16 may include an internal ridge 16*c* to limit the distance the second connecting ring 32 penetrates the third tube 16. In another embodiment, the ridges are not provided and the internal threads simply end in the area where the ridges are shown in FIG. 2, for example at the location where ridge 16*d* would be. Such an arrangement would also limit the distance to which the connecting rings can be screwed into their respective tubes.

Continuing to refer to FIG. 2, the top collar 18 includes a smooth upper section or ring 28 and a threaded lower section 34. The smooth upper section 28 provides a comfortable surface for touching to draw smoke from the bowl 24 through the stem 22 and device sections 12-20. The threaded lower section 34 threadably mates with the internal threads 12*a* in the first tube 12 until the upper section 28 engages the first tube 12. The first tube 12 may include an internal ridge 12*c* to make it interchangeable with the second and third tubes 14, 16.

Continuing to refer to FIG. 2, the base 20 includes a threaded upper section 20*a*, an enclosed lower section 20*b* and a threaded stem aperture 20*c* for connecting a stem 22 and a bowl 24. The threaded upper section 20*a* threadably mates with the internal threads 16*b* in the third tube 16. The third tube 16 may include an internal ridge 16*d* to make it interchangeable with the first and second tubes 12, 14. In one embodiment, the stem 22 has a threaded first end 22*a* and a threaded second end 22*b*. The threaded first end 22*a* threadably mates with the stem aperture 20*c* in the base 20. The bowl 24 has a threaded aperture 38 that threadably mates with the second 22*b* of the stem 22. A removable screen 26 is inserted in the bowl 24 to contain organic smoking material. In another embodiment, the stem 22 is fixed to the base 20 and/or the bowl 24.

Continuing to refer to FIG. 2, the second tube 14 and third tube 16 may be releasably connected together by the second threaded connecting ring 32 having an optional center ridge 36*a*. The second connecting ring 32 includes a threaded upper end 32*b* above the ridge 36*a* and a threaded lower end 32*c* below the ridge 36*a*. The ridge 36*a* acts as a stopper to limits the penetration of the second connecting ring 32 into the third tube 16. Similarly, a ridge 36*b* may be included on the threads 16*b* instead of the connecting ring 32, to prevent the connecting ring 32 from penetrating passed a predetermined distance within the third tube 16. Although not shown, it is contemplated that gaskets can be provided and located at the ends of connecting rings 30 and 32 to provide a resilient seal between the end of the connecting ring and the inner surface or ridge in the corresponding tube 12, 14 and/or 16. Similarly, in one embodiment, gaskets are provided between one or both of the top collar 18 and the base 20, and tubes 12 and 16, respectively. Providing a gasket between the base 20 and the tube 16 also provides a watertight arrangement to facilitate liquid, e.g., water, retention in the lower portion of the smoking device 10. Optionally, gaskets may be circumferentially disposed around the ridge 36*a* and/or ridge 36*b* or at the junction between any of the tubes 12, 14, and 16 and connecting rings 30, 32 and the base 20 to provide for a water tight seal as the tubes are threadably mated to the connecting rings.

Figure 3:
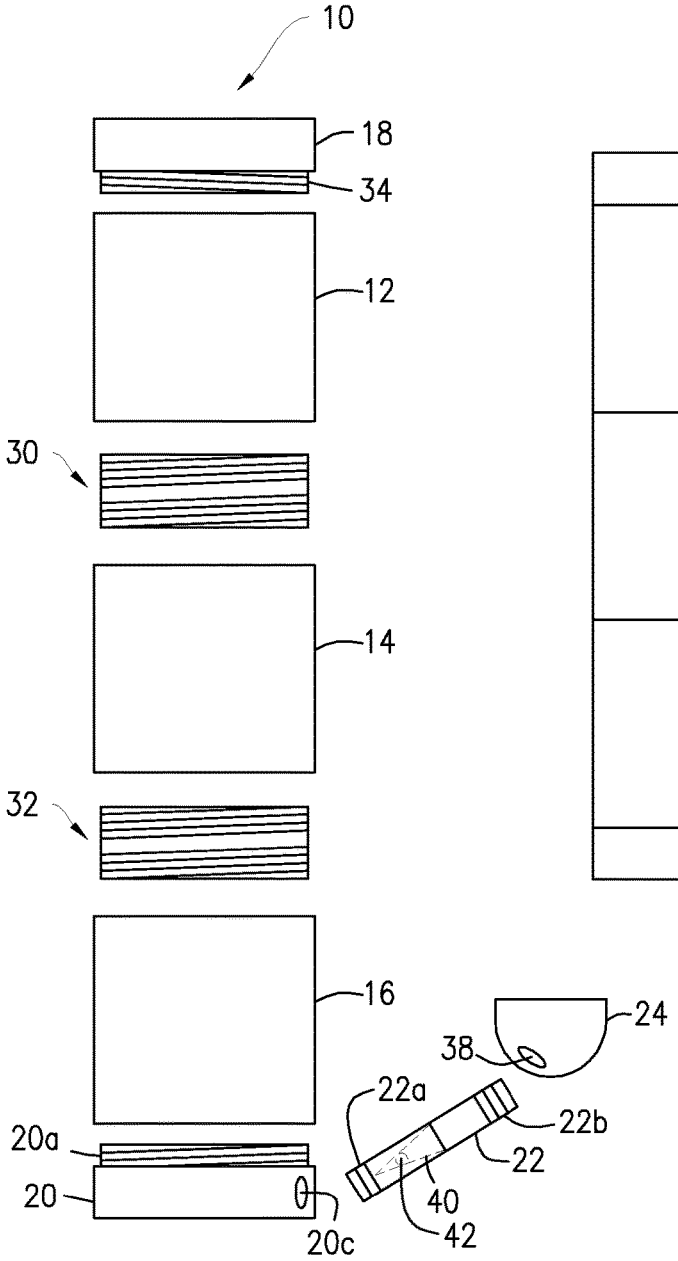
FIG. 3 is an exploded view of the embodiment of the smoking device shown in FIG. 2.
Figure 4:
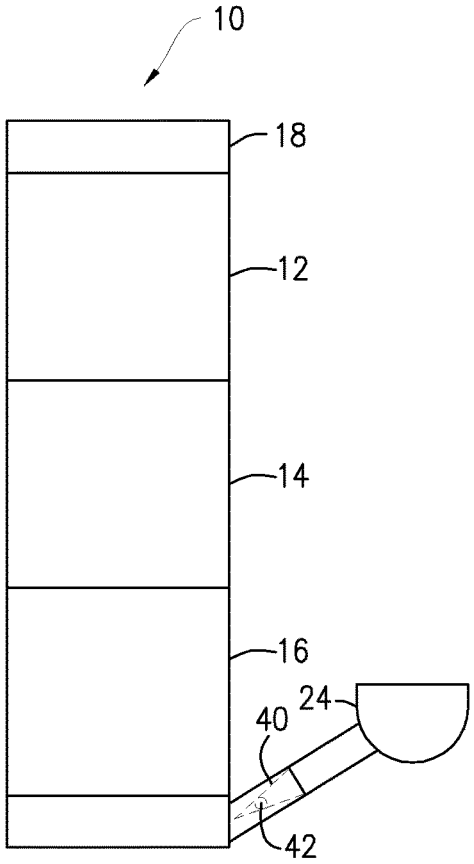
FIG. 4 is another view of the embodiment of the smoking device shown in FIG. 1.

Now referring to FIG. 3 and FIG. 4, the device 10 may include a stem 22 having a first end 22*a* attached to the base 20 and a second end 22*b* attached to the bowl 24 and a hollow cylinder with a one-way valve 40 in the hollow cylinder. The one-way valve 40 may include a stop 42 that plugs the valve 40 to block the passage of liquid, such as water, from the reservoir formed by the tubes and the base 20 into the bowl 24. When a user inhales through the top collar 18 the stop 42 unplugs the valve 40 allowing smoke to rise up the device 10 to the top collar. When the user exhales or ceases to inhale, the stop 42 reengages the point of the valve 40 to prevent the passage of water through the stem 22 and into the bowl 24. Of note, although FIGS. 2 and 3 show that the top collar 18 and the base 20 include threaded portions to screw into the corresponding pipes 12 and 20, the invention is not limited to this arrangement. It is contemplated that the top collar 18 and/or the base 20 may have internal threads like the tubes 12, 16 and 16, in which the top collar and/or the base 20 are coupled to the corresponding tubes 12 and 16 using connecting rings like the connecting rings 30 and 32 used to couple the tubes 12, 14 and 16 together.

Figure 5:
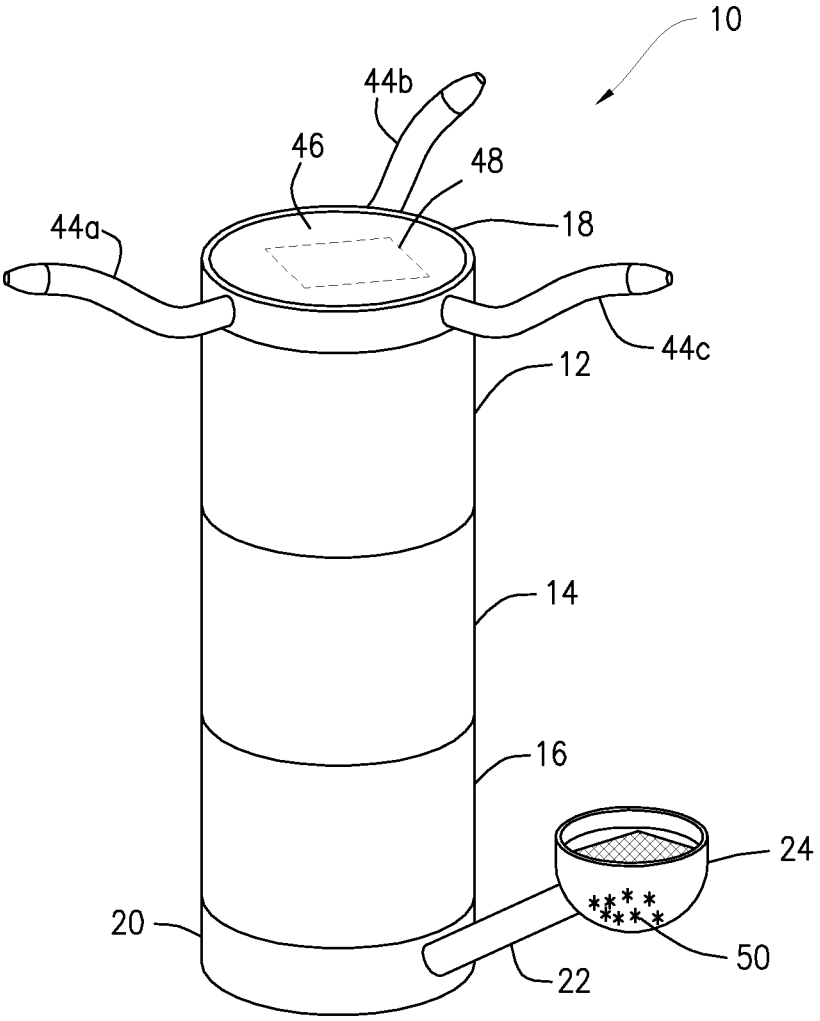
FIG. 5 is a perspective view of another smoking device constructed in accordance with the principles of the present invention.

Now referring to FIG. 5, the modular water pipe 10 may include a plurality of mouthpieces 44*a*-44*c* extending from the top collar 18 and the top collar 18 may be fluidly sealed with a top surface 46. The mouthpieces 44*a*-44*c* allow multiple users to simultaneously use the device 10. The mouthpieces 44*a*-44*c* may be disposable and in fluid communication with the reservoir. The bowl 24 may also be disposable. The bowl 24 may include a plurality of perforations or a screen 50 on its lower surface to facilitate heating the organic material from beneath the bowl. A vacuum device 48 may be attached to the top surface 46 of the top collar 18 to draw smoke upward toward the top collar 18.

The first tube 12, second tube 14 and bottom tube 16 may be made from a glass or glass-like material. In an exemplary configuration the first tube 12, second tube 14 and bottom tube 16, may be composed of multiple materials. For example, one or more the first tube 12, second tube 14 and bottom tube 16 may include a metal, for example, stainless steel on its exterior surface and may include glass or a glass-like material on its interior surface such that one or more of the first tube 12, second tube 14 and bottom tube 16 may be configured to insulate and trap the heat from the device 10 within the reservoir and allow the user to grip the exterior surface of the device without being burnt. The collar 18 and base 20 may also be made from a glass or glass-like material. The stem 22 and bowl 24 may be made from a glass or glass-like material. The glass or glass-like material may include Corningware®, porcelain, ceramic, Pyrex® or comparable materials with properties that do not readily conduct heat. The first connecting ring 30 and second connecting ring may be made from glass or a glass-like material, from plastic or from a metal material. The threaded cover mounts to the top of the smoking device and the bottom or base threadably mounts to the lower end of the device.

As noted above, the present invention may include rubber or rubber-like gaskets, i.e., o-rings (not shown) that help provide an air and water tight seal between the tubes 12, 14 and 16 and the first and second connecting rings 30 and 32, the stem 22 and base 20 and the stem 22 and base 24. As such the present invention provides a smoking pipe that is easily disassembled and reassembled, and which remains cool to the touch when in use. By providing a modular arrangement, users can also assemble the pieces to make a larger or smaller height smoking pipe based on the number of sections that are assembled.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. A smoking device for organic material, the smoking device comprising:

a plurality of threaded tubes, each of the threaded tubes having:
an internal surface;
a first end;
a second end opposite the first end;
first internal threads on the internal surface proximate the first end; and
second internal threads on the internal surface proximate the second end;

a plurality of threaded connecting rings, each of the threaded connecting rings having:
an external surface; and
threads around the external surface that threadably mate with the corresponding first internal threads on one of the plurality of threaded tubes and the second internal threads on another of the plurality of threaded tubes;

a base threadably matable to one of the plurality of threaded tubes; the base, the plurality of threaded tubes, and the plurality of threaded connecting rings cooperate when threadably mated to form a reservoir, the base disposed at one end of the reservoir;

a stem having a first end and a second end, the first end being connected to the base, the stem disposed at an angle to an axial direction of the reservoir; and a bowl connected to the second end of the stem.

2. The device of claim 1, further including:

a collar ring having a threaded first end and an unthreaded second end, the collar ring threaded first end threadably mating with the internal threads on one of the internal surface proximate the first end and the internal surface proximate the second end on the one of the plurality of threaded tubes opposite the base;

a threaded base aperture defined in the base; and the first end of the stem being threaded and removably threadably matable to the threaded base aperture.

3. The device of claim 1, wherein the bowl defines a threaded aperture, and wherein the second end of the stem is threaded and removeably threadably matable to the threaded bowl aperture.

4. The device of claim 1, further including a one-way valve disposed in the stem.

5. The device of claim 1, further including a screen disposed within the bowl.

6. The device of claim 3, wherein the bowl defines a plurality of apertures in addition to the threaded aperture.

7. The device of claim 1, wherein the plurality of threaded tubes are comprised of glass.

8. The device of claim 1, wherein each of the plurality of threaded connecting rings includes:

a first end;

a second end opposite the first end; and a raised ridge projecting circumferentially from the external surface between the first end and the second end of each threaded connecting ring.

9. The device of claim 1, wherein each of the plurality of threaded tubes include a first raised ridge projecting circumferentially from the internal surface proximate the first internal threads and a second raised ridge projecting circumferentially from the internal surface proximate the second internal threads.

10. A smoking device for organic material, the smoking device comprising:

a plurality of threaded tubes, each of the threaded tubes having:
an internal surface;
a first end;
a second end opposite the first end;
first internal threads on the internal surface proximate the first end; and
second internal threads on the internal surface proximate the second end;

a plurality of threaded connecting rings, each of the threaded connecting rings having:
an external surface;
threads around the external surface that threadably mate with the corresponding first internal threads on one of the plurality of threaded tubes and the second internal threads on another of the plurality of threaded tubes; and a concentric ridge proximate a midpoint on the external surface of each of the connecting rings to limit the distance the plurality of threaded connecting rings threadably mate with the plurality of threaded tubes;

a base threadably matable to one of the plurality of threaded tubes; the base, the plurality of threaded tubes, and the plurality of threaded connecting rings cooperate when threadably mated to form a reservoir, the base disposed at one end of the reservoir.

11. The device of claim 10, wherein the plurality of threaded tubes are comprised of glass.

12. The device of claim 11, wherein the plurality of threaded connecting rings are comprised of metal.

13. The device of claim 11, wherein the plurality of threaded connecting rings are composed of a glass-like material.

14. The device of claim 10, further including a collar ring, wherein the collar ring comprises a threaded first end which is threadably matable to the internal threads on one of the internal surface proximate the first end and the internal surface proximate the second end on the one of the plurality of threaded tubes opposite the base and a plurality of mouth pieces connected to the collar ring.

15. The device of claim 14, wherein the collar ring further comprises an unthreaded second end, and a top surface on the unthreaded second end to seal the reservoir.

16. The device of claim 15, further including a vacuum connected to the top surface of the collar ring for drawing air through the plurality of threaded tubes.

17. The device of claim 10, wherein the plurality of threaded tubes define a smooth exterior surface.

18. A smoking device for organic material, the smoking device comprising:

a plurality of threaded tubes, each of the threaded tubes having:

an internal surface;

a first end;

a second end opposite the first end;

first internal threads on the internal surface proximate the first end; and second internal threads on the internal surface proximate the second end;

a plurality of threaded connecting rings, each of the threaded connecting rings having:

an external surface;

threads around the external surface that threadably mate with the corresponding first internal threads on one of the plurality of threaded tubes and the second internal threads on another of the plurality of threaded tubes; and a concentric ridge proximate a midpoint on the external surface of each of the connecting rings to limit the distance the rings threadably mate into the plurality of threaded tubes;

a base threadably matable to one of the plurality of threaded tubes; the base, the plurality of threaded tubes, and the plurality of threaded connecting rings cooperate to form a reservoir, the base disposed at one end of the reservoir, the base defining a threaded base aperture;

a stem having a threaded first end and a threaded second end, the threaded first end being threadably connectable to the threaded base aperture;

a bowl having a threaded aperture, the threaded second end of the stem being threadably received within the threaded aperture of the bowl; and a one-way valve disposed within the stem for preventing a liquid from entering the bowl.

19. The device of claim 18, further including a collar ring having a threaded first end and an unthreaded second end, the collar ring being threadably matable to the internal threads on one of the internal surface proximate the first end and the internal surface proximate the second end on any one of the plurality of threaded tubes opposite the base, the collar ring including an overlay configured for placement over the unthreaded second end of the collar ring.

20. The device of claim 18, wherein the plurality of threaded tubes are comprised of glass.

* * * * *